US006575324B1

(12) United States Patent
Hamer

(10) Patent No.: US 6,575,324 B1
(45) Date of Patent: Jun. 10, 2003

(54) DEVICE FOR SEALING AN OPENED CARBONATED BEVERAGE CAN

(76) Inventor: Floyd Hamer, 5316 E. Harvey Way, Long Beach, CA (US) 90808

( * ) Notice: Subject to any disclaimer, the term of this patent is extended or adjusted under 35 U.S.C. 154(b) by 0 days.

(21) Appl. No.: 09/901,754

(22) Filed: Jul. 10, 2001

(51) Int. Cl.[7] ..... B65D 51/20

(52) U.S. Cl. ..... 220/258.5; 220/258.3; 220/259.3; 220/258.2; 220/259.2; 220/906; 220/315; 220/325; 206/459.5

(58) Field of Search ..... 40/311; 220/258.1, 220/258.2, 258.3, 258.5, 259.3, 259.5, 319, 256.1, 259.1, 259.2, 255, 315, 325, 906; 215/283, 230; 206/459.5

(56) References Cited

U.S. PATENT DOCUMENTS 5,232,115 A * 8/1993 Bauer ..... 220/259.3
5,839,596 A * 11/1998 Zahn et al. ..... 220/256.1
6,053,347 A * 4/2000 Fullin ..... 220/256.1

FOREIGN PATENT DOCUMENTS

GB 2029380 A * 3/1980

* cited by examiner

*Primary Examiner*—Robin Hylton
(74) *Attorney, Agent, or Firm*—Goldstein & Lavas, P.C.

(57) ABSTRACT

A carbonated canned beverage sealing device including a cover member having a circular member for positioning over an upper end of a beverage can. The cover member has an O-ring positionable inside the can rolled lip to effect a seal therewith. The circular ring has radial apertures each having rivets slidably disposed therein to abut the can below the rolled lip. A cap portion has a periphery for positioning over the cover member. Radially disposed tab housings extend outwardly and downwardly from the cap periphery in a spaced relationship corresponding with the rivets. Each tab housing has a hollow opening for receiving a rivet whereby the openings are positioned over the rivets. The cap portion-is rotated so that the rivets are pushed inwardly against the can below the can rolled lip to hold and effect a seal between the O-ring and the upper end of the carbonated beverage can.

5 Claims, 3 Drawing Sheets

DEVICE FOR SEALING AN OPENED CARBONATED BEVERAGE CAN

BACKGROUND OF THE INVENTION

The present invention relates to a carbonated canned beverage sealing device and more particularly pertains to preserving carbonation of a canned beverage after it has been opened but not completely consumed.

The use of receptacle closure devices is known in the prior art. More specifically, receptacle closure devices heretofore devised and utilized for the purpose of closing to receptacles are known to consist basically of familiar, expected and obvious structural configurations, notwithstanding the myriad of designs encompassed by the crowded prior art that have been developed for the fulfillment of countless objectives and requirements.

By way of example, U.S. Pat. No. 4,410,102 to Lutzker discloses a resealing closure for a carbonated beverage receptacle, comprised of a locking cap with a gasket and ratchet plate capable of being shifted into position to complete a hermetic seal. U.S. Pat. No. 5,209,362 to Lutzker discloses a resealing device comprised of a plurality of fingers with inwardly extending lugs for engaging the top of the can to preserve the carbonation. U.S. Pat. No. 5,711,447 to Plester discloses a resealable can assembly comprised of a set of knuckles on the can suited to engage a number of fingers on the inside of the lid as it is rotated downward.

While these devices fulfill their respective, particular objective and requirements, the aforementioned patents do not describe a carbonated canned beverage sealing which effectively seals a carbonated canned beverage for later consumption.

In this respect, the carbonated canned beverage sealing device according to the present invention substantially departs from the conventional concepts and designs of the prior art, and in doing so provides an apparatus primarily developed for the purpose of preventing a carbonated canned beverage from losing its carbonation after it has been opened and not completely consumed.

Therefore, it can be appreciated that there exists a continuing need for a new and improved carbonated canned beverage sealing device that can be used for preventing a carbonated canned beverage from going flat after it has been opened and not completely drunk. In this regard, the present invention substantially fulfills this need.

SUMMARY OF THE INVENTION

In the view of the foregoing disadvantages inherent in the known types of receptacle closure devices now present in the prior art, the present invention provides an improved carbonated canned beverage sealing device. As such, the general purpose of the present invention, which will be described subsequently in greater detail, is to provide a new and improved carbonated canned beverage sealing device that has all the advantages of the prior art and none of the disadvantages.

To attain this, the present invention essentially comprises a cover member having a circular ring, dimensioned for positioning over an upper end of a carbonated beverage can having a rolled lip at said upper end. The circular ring has an O-ring positioned therein. The circular ring has three radial apertures extending therethrough at one hundred twenty degree intervals. The apertures each have rivets slidably disposed therein for selectively engaging and releasing the can. The rivets each have inner ends and outer ends. The inner ends selectively abut the beverage-can immediately below the rolled lip. The outer ends are disposed outside of the circular ring. A circular cap portion is dimensioned for positioning over the cover member. The cap portion has a periphery having three radially disposed tab housing extending downwardly and outwardly therefrom at one hundred-twenty degree intervals. Each tab housing has a hollow therein for receiving a corresponding rivet of the circular ring. The hollow is defined by a wide first side and a narrow second side with a gradual slope therebetween whereby the wide first sides are positioned over the rivets when the cap is in the open position. To seal against the can, the cap portion is rotated with respect to the cover member so that the rivets are directed toward the narrow second sides whereby the rivets are pushed against the can immediately below the rolled lip to hold the O-ring against the upper end of the carbonated beverage can to effect a seal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved carbonated canned beverage sealing device that has all the advantages of the prior art receptacle closure devices and none of the disadvantages.

It is another object of the present invention to provide a new and improved carbonated canned beverage sealing device that may be easily and efficiently manufactured and marketed.

It is a further object of the present invention to provide a new and improved carbonated canned beverage sealing device that is of durable and reliable construction.

An even further object of the present invention is to provide a new and improved carbonated canned beverage sealing device that is susceptible of a low cost of manufacture with regard to both materials and labor, and which accordingly is then susceptible of low prices of sale to the consuming public, thereby making such a carbonated canned beverage sealing-device economically available to the buying public.

Even still another object of the present invention is to provide a new and improved carbonated canned beverage sealing device for preventing a carbonated canned beverage from losing its carbonation after it has been opened but has not been fully consumed.

Lastly, it is an object of the present invention to provide a new and improved carbonated canned beverage sealing device including cover member having a circular ring dimensioned for positioning over an upper end of a carbonated beverage can. The circular ring has an O-ring positionable inside a rolled lip of the carbonated beverage can. The circular ring has a plurality of lateral apertures therethrough in a spaced relationship. The apertures each have rivets slidably disposed therein to abut the beverage can just under the rolled lip. A circular cap portion having a periphery is dimensioned for positioning over the cover member. A plurality of radially disposed tab housings extend downwardly and outwardly from the periphery of the cap in a spaced relationship corresponding with the rivets. Each tab housing has a hollow therein for receiving a corresponding rivet of the circular ring whereby the openings are positioned over the rivets and then the cap portion is rotated so that the rivets are pushed inwardly against the beverage can immediately under the rolled lip to secure the can and hold the O-ring in place against the upper end of the carbonated beverage can for proper sealing thereof.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
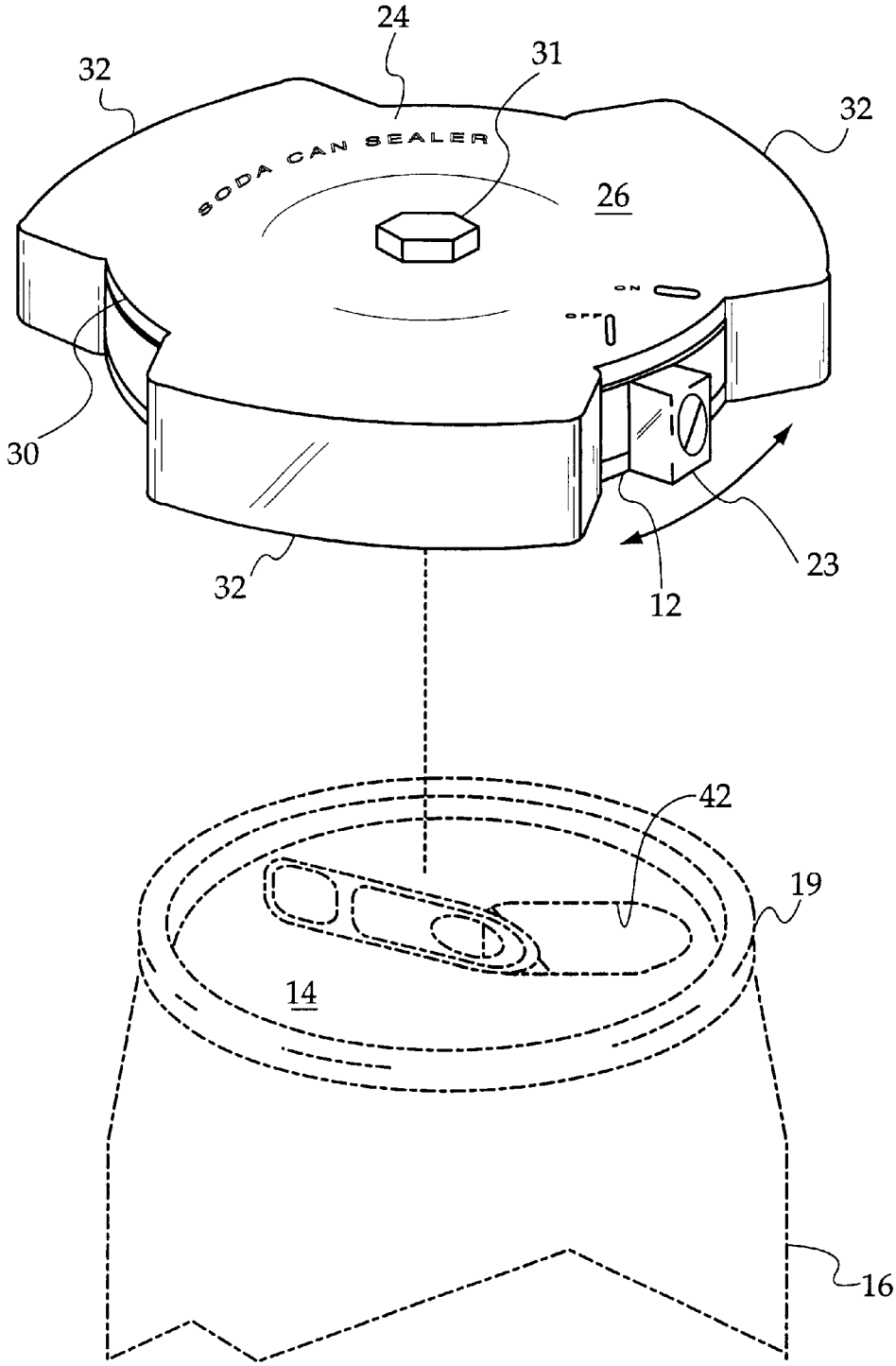
FIG. 1 is a perspective view of the preferred embodiment of the carbonated canned beverage sealing device constructed in accordance with the principles of the present invention, wherein the device is about to be applied to a beverage can.
Figure 2:
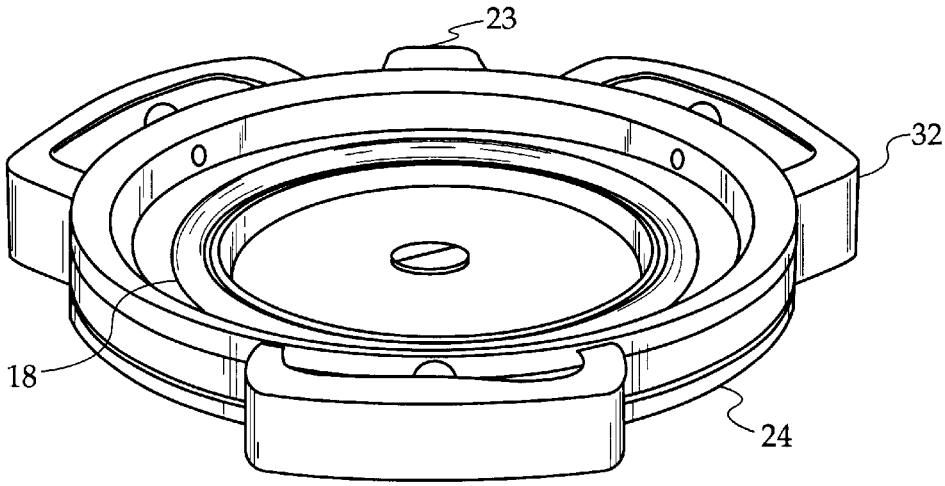
FIG. 2 is a bottom perspective view of the present invention.
Figure 3:
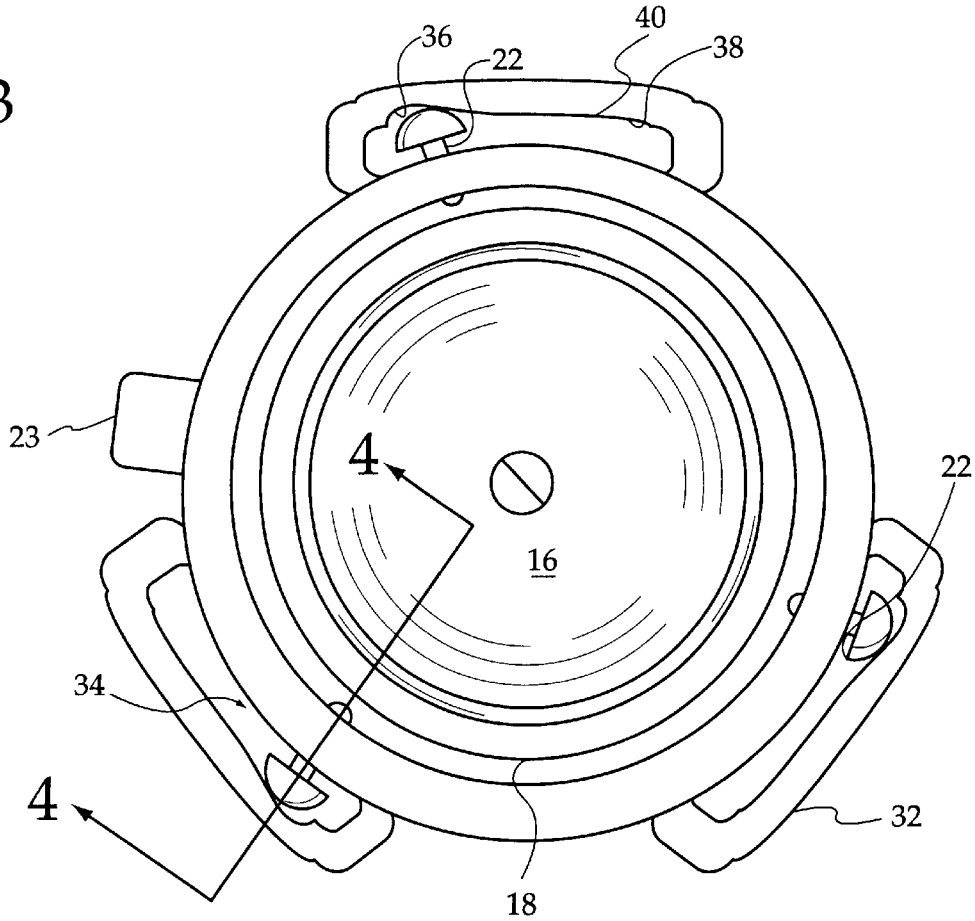
FIG. 3 is a top plan view of the present invention showing the rivets being pushed inward by the slopes within the hollows to engage and lock against the can.
Figure 4:
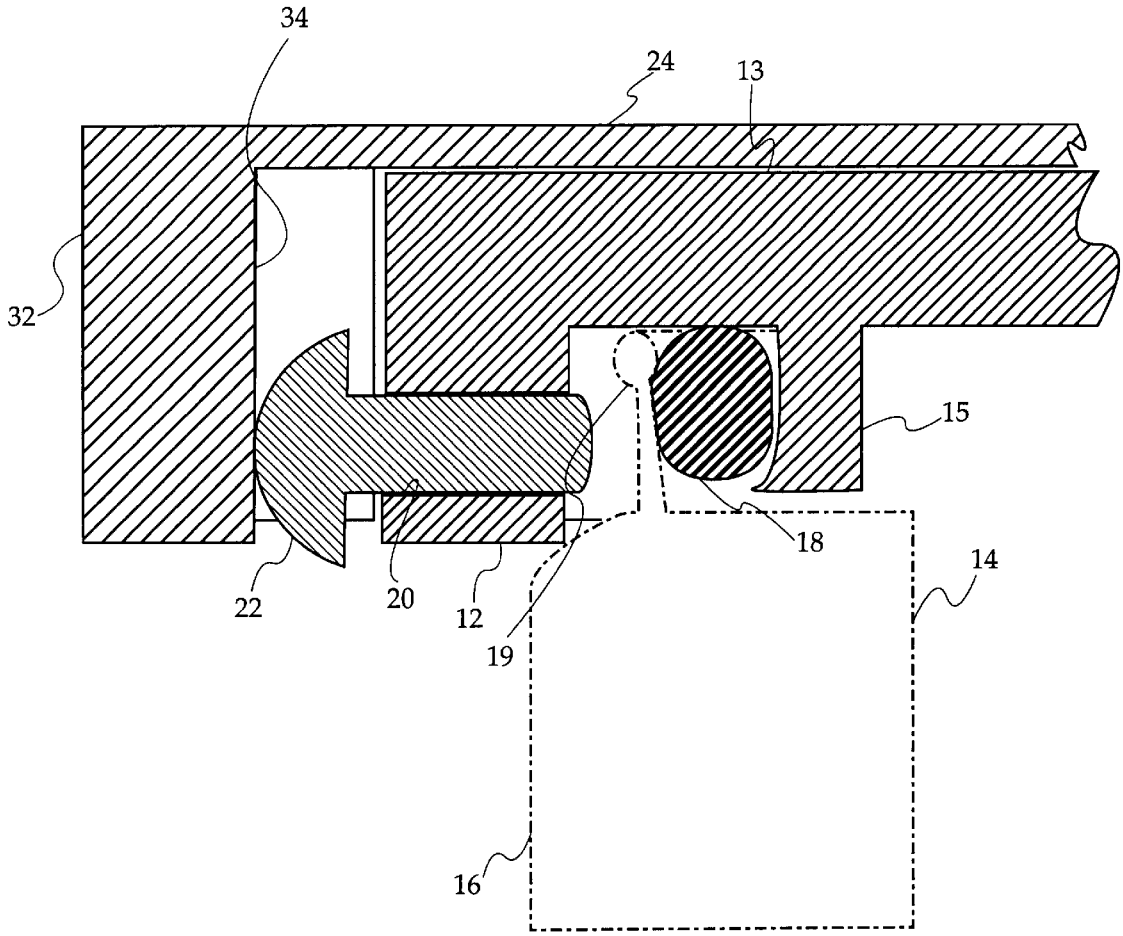
FIG. 4 is a cross-sectional view of the present invention as taken along line 4—4 of FIG. 3.

With reference now to the drawings, and in particular, to figures one through four thereof, the preferred embodiment of the new and improved carbonated canned beverage sealing device embodying the principles and concepts of the present invention and generally designated by the reference number 10 will be described.

Specifically, it will be noted in the various figures that the device relates to a carbonated canned beverage sealing device for preventing a carbonated canned beverage from losing carbonation after it has been opened and not completely consumed. In its broadest context, the device consists of a circular ring and a circular cap portion. Such components are individually configured and correlated with respect to each other so as to attain the desired objective.

The cover member 13 and its circular ring 12 are dimensioned for positioning over an upper end 14 of a carbonated beverage can 16. The cover member 13 also has a central aperture therethrough. The cover member has an annular ring 15 extending downwardly therefrom. The annular ring 15 is concentric with the circular ring 12. The circular ring 12 has an O-ring 18 positioned therein. The O-ring 18 is mounted between the circular ring 12 and the annular ring 15. In use, the O-ring 18 is positionable between the inner periphery of a rolled lip 19 of the carbonated beverage can 16 and the annular ring 15 of the cover member 13. The circular ring 12 has three radial apertures 20 extending therethrough at one hundred twenty degree intervals. The apertures 20 each have rivets 22 slidably disposed therein. The rivets 22 have inner ends and outer ends. The inner ends abut immediately under the rolled lip 19 of the carbonated beverage can 16. The outer ends are disposed outside of the circular ring 12. The circular ring 12 has a handle member 23 extending radially therefrom.

The circular cap portion 24 is dimensioned for positioning directly over the cover member 13. The cap portion 24 has a periphery 30. A central aperture extends through the cap 24, and the cover member 13 has a central aperture coaxial therewith for receiving a bolt and nut 31 therethrough to allow relative rotation of the cap 24 and circular ring 12. The periphery has three circumferentially disposed tab housings 32 extending outwardly and downwardly therefrom at one hundred twenty degree intervals. Each tab housing 32 has a hollow 34 therein for receiving a corresponding rivet 22 of the circular ring 12. The opening 34 is defined by a wide first side 36 and a narrow second side 38 with a gradual slope 40 therebetween whereby the wide first sides 36 are positioned over the rivets 22 when in the open position. To seal the device upon the cans, the cap portion 24 is rotated so that as the rivets 22 are moved within the hollow 34 toward the narrow second sides 38, the rivets 22 are pushed inwardly by the slope 40 toward the can to engage and hold the rolled lip 19 of the upper end of said carbonated beverage can 16 while the O-ring 18 and the annular ring 15 of the cover member 13 to effectively seal an opening 42 in the upper end 14 of the can so that carbonation remains in the can 16. Simply rotating the cap 24 in the opposite direction releases the rivets 22 and allows the device to be removed so that consumption of the beverage can resume. The user should hold the handle member 23 while turning the cap portion 24 to hold the circular ring in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A carbonated canned beverage sealing device for use with a beverage can having an open upper end and a rolled lip, for preventing a carbonated beverage therein from losing carbonation after it has been opened and not completely consumed, comprising:

a cover member having a circular ring dimensioned for positioning over the upper end of the carbonated beverage can, the cover member having a central aperture therethrough, the cover member having an annular ring extending downwardly therefrom and concentric with the circular ring, the cover member having an O-ring positioned therein between the annular ring and circular ring, when the rolled lip of the carbonated beverage can is inserted upwardly into the cover member between the annular ring and the circular ring the O-ring is positioned between the rolled lip of the carbonated beverage can and the annular ring of the cover member, the circular ring having three radial apertures therethrough at one hundred twenty degree intervals, the apertures each having rivets slidably disposed therein, the rivets having inner ends and outer ends, the inner ends selectively abutting immediately below-the rolled lip of the beverage can, the outer ends being disposed outside of the circular ring, the circular ring having a handle member extending radially therefrom; and a circular cap portion dimensioned for positioning over the cover member and circular ring, the cap portion having a periphery and a central aperture, the central aperture for aligning with the central aperture of the cover member for receiving a bolt and nut therethrough, the periphery having three radially disposed tab housings extending outwardly and downwardly therefrom at one hundred twenty degree intervals, each tab housing having a hollow opening therein for receiving a corresponding rivet of the circular ring, the opening being defined by a wide first side and a narrow second side with a gradual slope therebetween whereby the wide first sides are initially positioned over the rivets and when the cap portion is rotated with respect to the cover member the rivets are directed toward the narrow second sides such that when the rolled lip of the upper end of the carbonated beverage can is located between the circular ring and annular ring and the cap portion is rotated with respect to the cover member the rivets are pushed inwardly to hold the rolled lip of the upper end of the carbonated beverage can while the O-ring and the annular ring of the cover member effect a seal with said can.

2. A carbonated canned beverage sealing device for use in selectively sealing a can having an open upper end and a rolled lip, the can containing a carbonated beverage, comprising:

a cover member having a circular ring dimensioned for positioning over the upper end of the carbonated beverage can, the circular ring having an O-ring positioned therein, when the cover member is placed over the upper end of the carbonated beverage can the O-ring is positioned inside the rolled lip of said carbonated beverage can to effect a seal with the beverage can, the circular ring having a plurality of radial apertures extending therethrough in a spaced relationship, the apertures each having rivets slidably disposed therein, the rivets having inner ends and outer ends, such that when the circular ring is positioned on the beverage can the inner ends abut immediately below the rolled lip of said beverage can, the outer ends being disposed outside of the circular ring; and a circular cap portion dimensioned for positioning over the circular ring, the cap portion having a periphery, the periphery having a plurality of radially disposed tab housings extending outwardly and downwardly therefrom in a spaced relationship corresponding with the rivets, each tab housing having a hollow therein for receiving a corresponding rivet of the circular ring whereby the tab housings are positioned over the rivets and when the cap portion is rotated the rivets are pushed by the hollow opening inwardly against said beverage can immediately below the rolled lip of said beverage can to hold the upper end of said carbonated beverage can in a sealing position.

3. The carbonated canned beverage sealing device as set forth in claim 2, wherein the cover member has an annular ring extending downwardly therefrom such that when the rolled lip of the beverage can is placed between the circular ring and the annular ring the O-ring is positioned between inwardly of the rolled lip of the carbonated beverage can and the annular ring of the cover member.

4. The carbonated canned beverage sealing device as set forth in claim 3, wherein the cover member has a central aperture and wherein the cap portion also has a central aperture therethrough for aligning with the central aperture of the cover member for receiving a bolt and nut therethrough to allow relative rotation of the circular ring and the cap portion.

5. The carbonated canned beverage sealing device as set forth in claim 2, wherein the circular ring has a handle member extending radially therefrom to allow the user to rotate the cover member with respect to the cap portion.

* * * * *